US005369328A

United States Patent [19]

Gruber et al.

[11] Patent Number: 5,369,328

[45] Date of Patent: Nov. 29, 1994

[54] SPARK PLUG HAVING Y-SHAPED OR V-SHAPED ELECTRODES

[75] Inventors: Friedrich Gruber, Hippach, Austria; Hans-Jörg Pucher, Fürstenfeldbruck, Germany; Reinhard Auer, deceased, late of Brandenberg, Austria, by Reuck Aéer, legal representative

[73] Assignee: Jenbacher Energiesysteme AG, Jenbach, Austria

[21] Appl. No.: 962,578

[22] PCT Filed: Jun. 28, 1991

[86] PCT No.: PCT/AT91/00075

§ 371 Date: Dec. 24, 1992

§ 102(e) Date: Dec. 24, 1992

[87] PCT Pub. No.: WO92/00620

PCT Pub. Date: Jan. 9, 1992

[30] Foreign Application Priority Data

Jul. 2, 1990 [AT] Austria ..... 1402/90

[51] Int. Cl.[5] ..... H01T 13/20

[52] U.S. Cl. ..... 313/141; 313/140

[58] Field of Search ..... 313/141, 140, 143

[56] References Cited

U.S. PATENT DOCUMENTS

| | | | |
|---|---|---|---|
| 4,488,081 | 12/1984 | Kondo et al. | 313/141 |
| 4,826,462 | 5/1989 | Lenk | 475/7 |
| 4,893,051 | 1/1990 | Kondo | 313/141 |
| 5,107,168 | 4/1992 | Friedrich et al. | 313/141 |
| 5,189,333 | 2/1993 | Kagawa et al. | 313/143 |

FOREIGN PATENT DOCUMENTS

| | | |
|---|---|---|
| 1941979 | 12/1980 | Germany . |
| 3132814 | 4/1982 | Germany . |
| 3730627 | 3/1988 | Germany . |
| 8902032 | 6/1989 | Germany . |

*Primary Examiner*—Donald J. Yusko
*Assistant Examiner*—Matthew J. Esserman
*Attorney, Agent, or Firm*—Lorusso & Loud

[57] ABSTRACT

A spark plug with a central electrode insulated against the plug thread having ground electrodes electrically connected to the plug thread, in which a prism-shaped cap is arranged at the end of the central electrode in the combustion chamber and the ground electrodes are parallel to the sides of the prism of the cap. The ground electrodes consist of at least one holder of a base or semi-precious metal on which a thin electrode layer of platinum or a platinum alloy is arranged facing the cap of the central electrode. The ground electrodes are configured in the form of a V-shape or a Y-shape.

4 Claims, 3 Drawing Sheets

SPARK PLUG HAVING Y-SHAPED OR V-SHAPED ELECTRODES

FIELD OF THE INVENTION

The invention relates to a spark plug having a center electrode which is insulated relative to the plug screwthread, and ground electrodes which are electrically connected to the plug screwthread, wherein mounted at the combustion chamber end of the center electrode is an attachment portion which at least partially comprises preferably platinum or a platinum alloy, the spark paths lying between the attachment portion and the ground electrodes which go thereto from the side

BACKGROUND OF THE INVENTION

Spark plugs are of interest, which have a very long service life and which in particular exhibit a low level of consumption of the electrodes due to their burning away, but which nonetheless can be operated with relatively low ignition voltages. If necessary they should afford convenient adjustability, with a defined electrode gap.

SUMMARY OF THE INVENTION

In accordance with an aspect of the invention, it is provided that the attachment portion is substantially in the form of a prism which faces with the top surface towards the combustion chamber and the ground electrodes extend laterally beside the side surface of the substantially prism-shaped attachment portion substantially parallel the prism edges of the top surface and the bottom surface, respectively, and that the ground electrodes comprise at least one carrier of base metal or semi-precious metal, preferably nickel, on which is arranged, towards the attachment portion of the center electrode, a thin electrode layer of platinum or a platinum alloy.

It would be desirable in relation to spark plugs to achieve high local field strengths between the center electrode and the ground electrodes in order to require an ignition voltage which is as low as possible. High field strengths of that kind can be achieved by virtue of pointed electrode configurations. However that then involves the disadvantage that such electrodes burn away relatively quickly. A possible form of improvement in that respect lies in the use of suitable materials. However, that has also not given satisfactory results, with the previous electrode geometries. With the electrode geometry corresponding to the present invention, in which the attachment portion on the center electrode of preferably platinum or a platinum alloy essentially involves the outside shape of a prism, the sharp prism edges provide a high local field strength and thus a reduction in the ignition voltage. At the same time the level of electrode consumption due to burning away is kept within limits due to the relatively long effective overall length of the prism edges. With that configuration, the spark paths lie between the attachment portion and the ground electrodes which extend laterally beside the attachment portion substantially parallel to the prism edges of the top surface and the bottom surface, respectively, and they, therefore, practically surround the entire prism-shaped attachment portion. Due to the ground electrodes extending parallel to the side surfaces of the prism-shaped attachment portion of platinum, the electrode consumption which occurs in any case only to a low degree is also relatively uniform, so that, if necessary, that arrangement affords simple adjustability with a well-defined electrode gap.

In the case of the attachment portion on the center electrode, the important consideration in regard to the properties of the plug in terms of electrode burning and ignition sparking is essentially the external shape, in particular the long prism edges, while the bottom surface generally at least contributes to joining the attachment portion to the center electrode. In order to keep down the amount of electrode burning, it is important that the regions of the prism-shaped attachment portion, which are disposed at the spark path, comprise platinum or a platinum alloy, while the center portion can comprise base metal and/or semi-precious metal. Such a version simultaneously permits a firm connection between the attachment portion and the center electrode, while also providing for a saving of material in terms of expensive platinum.

In accordance with an embodiment, the attachment portion is in the shape of a right prism with square bottom and top surfaces. That construction affords the possibility of providing ground electrodes which are preferably square in cross-section and which are angled at a right angle, each of which has a limb extending parallel to a side surface of the attachment portion while the other limb extends parallel to the adjoining side surface of the attachment portion. That arrangement provides that two side surfaces of the attachment portion are involved with each ground electrode, while particularly high field strengths occur between the heightwise edges of the prism and the inside angle of the angled ground electrodes.

A feature of the invention provides that the ground electrodes comprise at least one carrier of base metal or semi-precious metal, preferably nickel, on which is disposed, towards the attachment portion of the center electrode, a thin electrode layer of platinum or a platinum alloy.

That feature provides for a substantial saving on expensive noble metal (platinum or platinum alloy). As the ground electrode carrier comprises base metal or semi-precious metal, it does not have to be designed in such a way as to save on material, which means that the arrangement provides for good dissipation of heat by way of the ground electrode carrier.

The thin electrode layer of the noble metal platinum or a platinum alloy can be welded or soldered or brazed in the form of thin bars on to the carrier which may take the form of Y-shape or a V-shape. Instead of that, however, it is also possible for the thin electrode layer of platinum or the platinum alloy to be applied to the carrier in the form of a coating, for example by vapor deposition. It is sufficient for the thin electrode layer of platinum or a platinum alloy to be of a layer thickness of less than 1 mm Preferably the layer thickness can be of the order of magnitude of from about 0.1 mm to about 0.5 mm.

A further feature of the invention provides that each two ground electrodes are combined to provide a component which is V-shaped or Y-shaped in plan view, wherein the two V- or Y-electrode arms extend at least approximately parallel to the respective two side surfaces of the attachment portion of the center electrode and a common web portion leads from the apex of the electrode arms to the ground body of the spark plug.

That design configuration provides for good stability for the ground electrodes. Furthermore, that design configuration also has an advantageous effect on adjustability of the electrode gap between the ground electrodes and the center electrode, in which respect each two electrode arms are adjustable jointly and simultaneously.

The V-shaped or Y-shaped component of the ground electrodes may comprise any metal but preferably semi-precious metal such as for example nickel or noble metal such as for example platinum. It will be appreciated that it is also possible to consider corresponding metal alloys or metal combinations, for example such that the V-shape or Y-shaped component comprises a semi-precious metal as a carrier for a thin electrode layer of noble metal, in particular platinum or a platinum alloy.

The publication DE-U-89 02 032 discloses an electrode geometry in which the attach portion on the center electrode of preferably platinum or a platinum alloy is essentially in the outside shape of a prism, the sharp prism edges providing a high local field strength and thus a reduction in the ignition voltage. At the sane time the level of electrode consumption due to burning away is kept within limits due to the relatively long effective overall length of the prism edges. With that configuration the spark paths lie between the attachment portion and the ground electrodes which extend laterally beside the attachment portion substantially parallel to the prism edges of the top surface and the bottom surface respectively, and they therefore practically surround the entire prism-shaped attachment portion. Due to the ground electrodes extending parallel to the side surfaces of the prism-shaped attachment portion of platinum, the electrode consumption which occurs in any case only to a low degree is also relatively uniform. The ground electrodes are of an L-shaped configuration and can be provided with platinum.

In accordance with a preferred embodiment of the invention, and to save on expensive noble metal, it is provided that the ground electrodes comprise at least one carrier of base metal or semi-precious metal, preferably nickel, which is provided, facing towards the attachment portion of the center electrode, with platinum or a platinum alloy, wherein the platinum or the platinum alloy is arranged in the form of a thin electrode layer on the carrier and the electrode layer is formed by thin bars of platinum or a platinum alloy which are welded or brazed or soldered on to the carrier and which are parallel to the ground electrodes and are parallel to the sides of the attachment portion.

For the same purpose another preferred embodiment has a thin platinum electrode layer, wherein said electrode layer is formed by thin bars of platinum or a platinum alloy which are welded or soldered or brazed on to the carrier and which are parallel to the ground electrodes and are parallel to the sides of the attachment portion.

The invention is described in greater detail hereinafter by means of an embodiment with reference to the drawings.

DETAILED DESCRIPTION OF THE PREFERRED EMBODIMENTS

Figure 1:
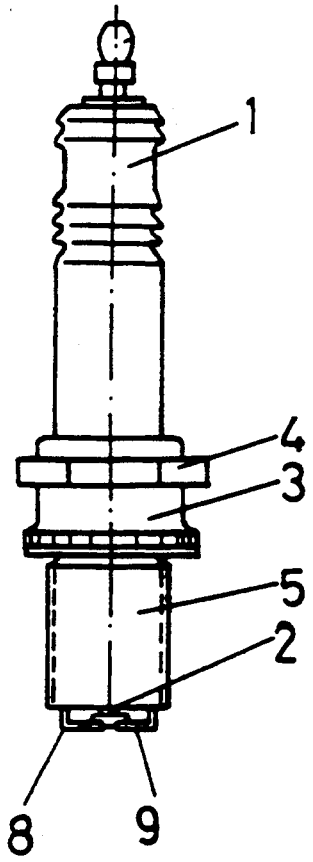
FIG. 1 shows a side view of a spark plug according to the invention.

The spark plug shown in FIG. 1 has an insulating body 1 for insulation of the center electrode 2 relative to the casing 3 which in operation is grounded and which comprises metal and which is formed in one piece with a hexagonal nut 4 and a screwthread portion 5.

Figure 4:
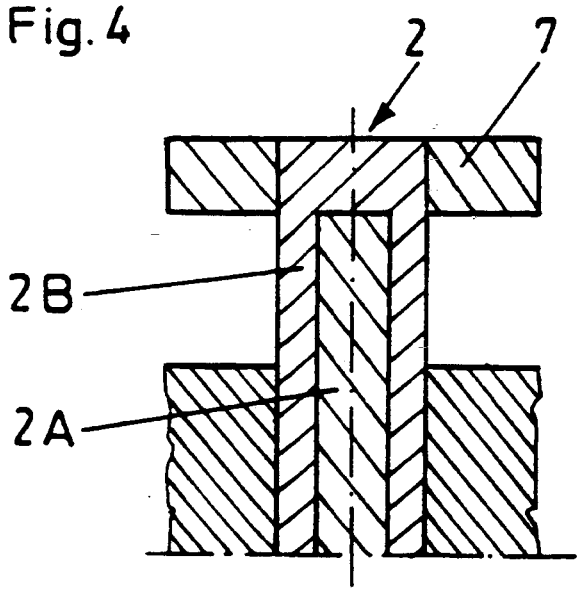
FIG. 4 is a view in section of the center electrode.
Figure 2:
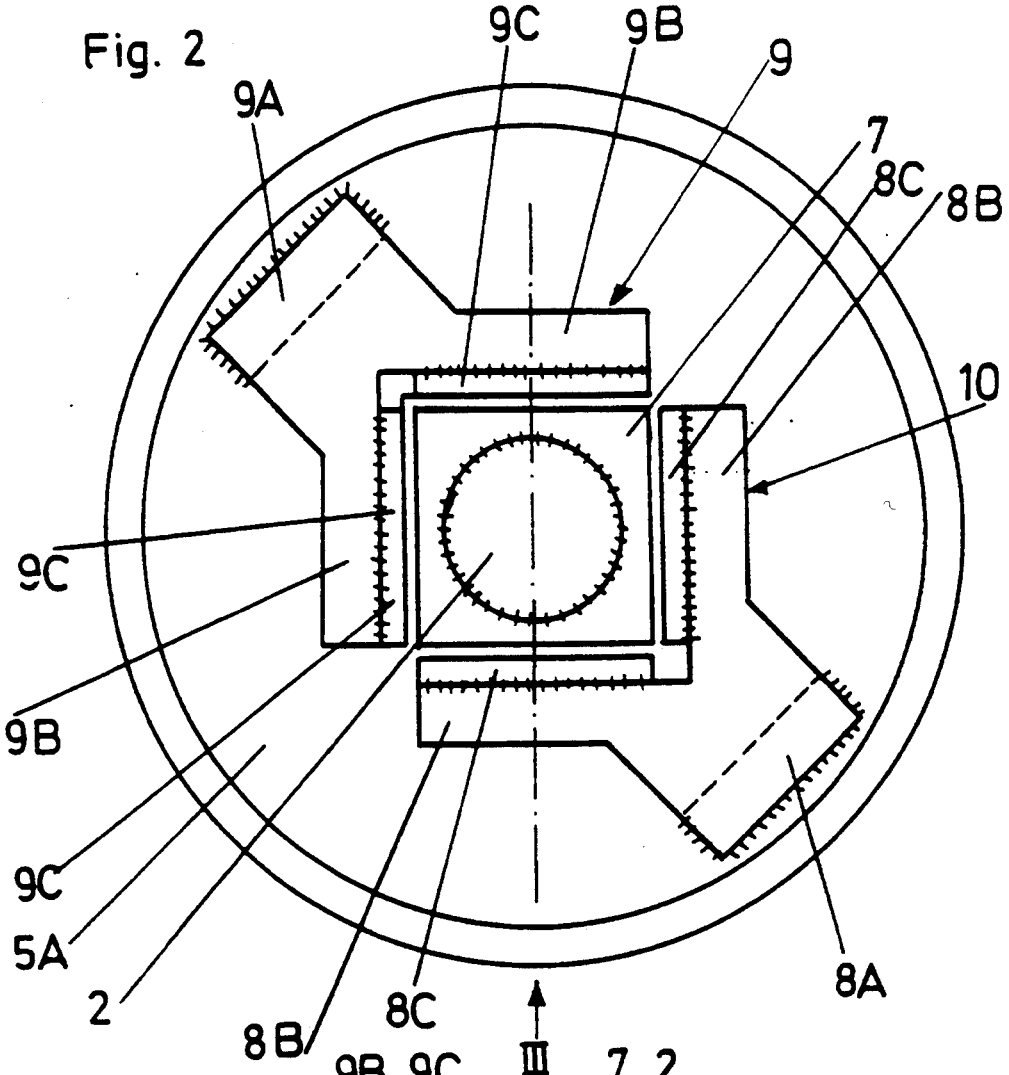
FIG. 2 is a plan view on an enlarged scale of the head, which is towards the combustion chamber, of the spark plug.
Figure 3:
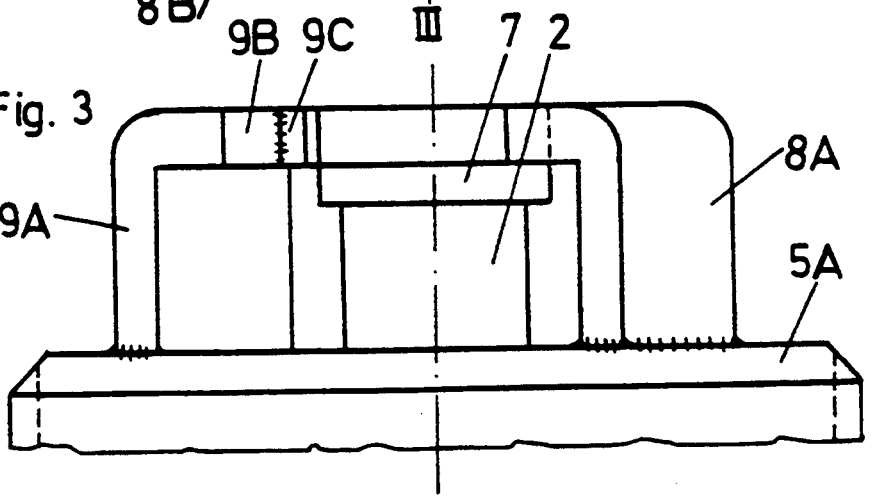
FIG. 3 is a side view of FIG. 2 looking in the direction indicated by the arrow III in FIG. 2.

As can be seen from FIGS. 2–4, the center electrode 2 has a prism-shaped attachment portion 7 which is square in plan view and which comprises a platinum-rhodium alloy. The prism-shaped attachment portion is carried by a pin-shaped part of the center electrode which projects into a central opening in the attachment portion 7 and is welded or soldered or brazed thereto.

The pin-shaped part comprises for example a core 2A of copper and a jacket 2B of nickel (FIG. 4).

The ground electrodes 8, 9 of the spark plug each comprise a carrier 8A, 8B, 9A, 9B of base metal or semi-precious metal, for example nickel, which is connected to the ground ring 5A of the screwthread portion 5. Arranged on the arms 8B, 9B of the carrier, being for example L5 welded or soldered or brazed thereto, and facing towards the prism-shaped attachment portion 7 of the center electrode 2, is a respective thin layer 8C, 9C of platinum or a platinum alloy, for example a platinum-rhodium alloy.

In plan view on to the head of the spark plug, which is towards the combustion chamber, the carrier 8A, 8B or 9A, 9B respectively is of a Y-shape, wherein the thin electrode layer 8C, 9C is arranged on the mutually facing inward sides of the two Y-electrode arms 8B, 9B, and each two electrode arms 8B—8B and 9B—9B respectively are connected to the ground ring 5A by way of a respective common web portion 8A and 9, respectively.

Figure 5:
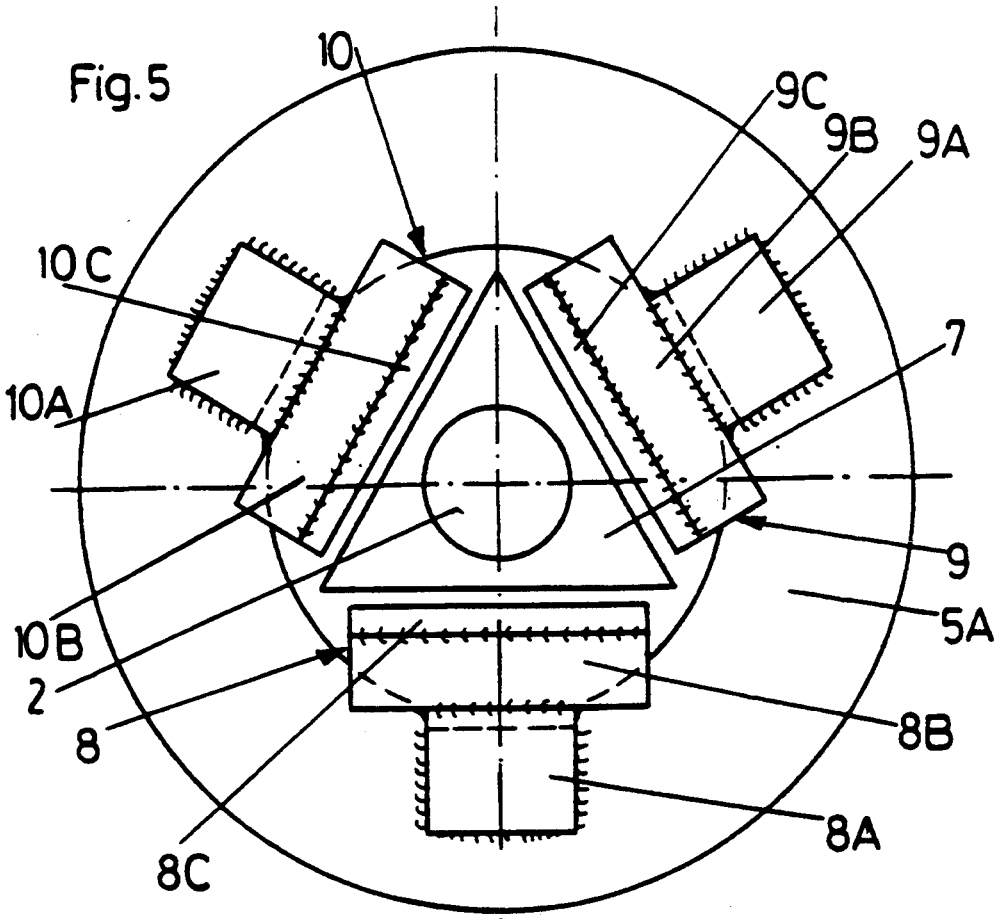
FIG. 5 is a plan view, from the combustion chamber, of a further embodiment of a spark plug according to the invention.
Figure 6:
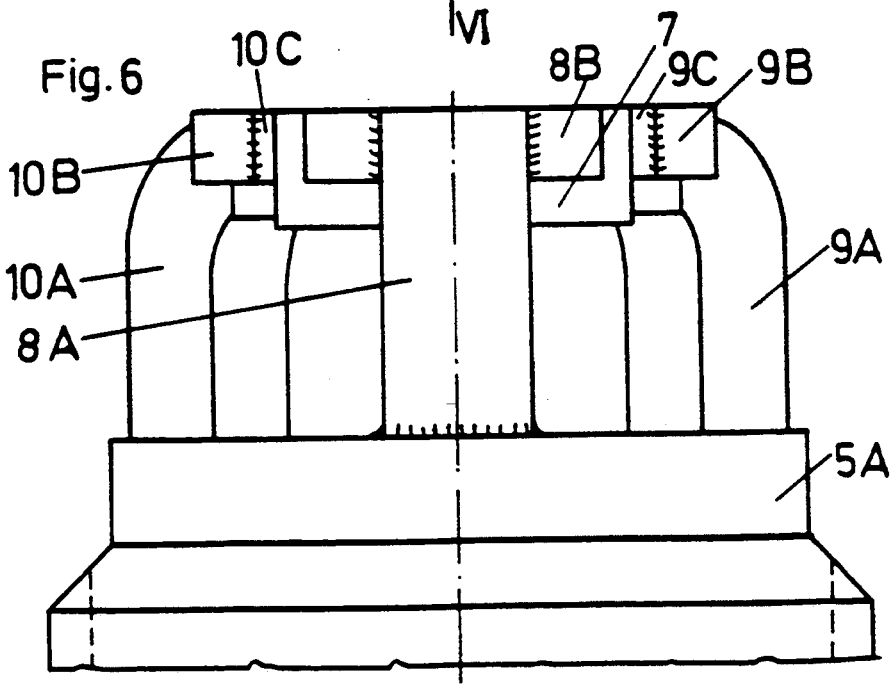
FIG. 6 is an associated side view looking in the direction of the arrow VI in FIG. 5

In the embodiment shown in FIGS. 5 and 6 the prism-shaped attachment portion 7 of the center electrode 2 is of a triangular contour. A ground electrode 8, 9, 10 is associated with each of the three sides of the attachment portion 7. The ground electrodes each comprise a respective carrier of base metal or semi-precious metal, which is connected to the ground ring 5A, while each carrier comprises a web portion 8A, 9A, 10A which projects from the ground ring 5A, and an arm 8B, 9B, 10B. The arms are parallel to the three sides of the attachment portion 7, respectively and, facing towards the attachment portion 7, each carry a respective thin layer 8C, 9C, 10C of platinum or a platinum alloy.

It is claimed:

1. A spark plug having a center electrode which is insulated relative to the plug screwthread, and ground electrodes which are electrically connected to the plug screwthread, wherein mounted at the combustion chamber end of the center electrode is an attachment portion which at least partially comprises platinum or a platinum alloy, the spark paths lying between the attachment portion and the ground electrodes, wherein the attachment portion is substantially in the form of a prism having a plurality of side surfaces, the ground electrodes extending laterally beside the side surfaces of the substantially prism-shaped attachment portion substantially parallel to the prism edges of a top surface and a bottom surface, respectively, and wherein the ground electrodes are combined to provide a respective component whose two electrode arms extend at least approximately parallel to respective two side surfaces of the attachment portion of the center electrode, characterized in that a common web portion leads from an apex formed by the electrode arms of the component which is of a V-shaped or Y-shaped configuration to the ground body of the spark plug.

2. A spark plug set forth in claim 1 characterized in that the ground electrodes comprise at least one carrier of base metal or semi-precious metal, preferably nickel, which is provided, facing towards the attachment portion of the center electrode, with platinum or a platinum alloy, wherein the platinum or platinum alloy is arranged in the form of a thin electrode layer on the carrier by thin bars of platinum or platinum alloy which are welded or soldered or brazed on to the carrier and which are parallel to the ground electrodes.

3. A spark plug as set forth in claim 1 characterized in that the ground electrodes comprise at least one carrier of base metal or semi-precious metal, preferably nickel, which is provided, facing towards the attachment portion of the center electrode, with platinum or a platinum alloy, wherein the platinum or the platinum alloy is vapor deposited in the form of a thin electrode layer on to the carrier.

4. A spark plug as set forth in claim 2 characterized in that the thin electrode layer has a layer thickness of less than 1 mm, preferably of the order of magnitude of about 0.1 mm to about 0.5 mm.

* * * * *

UNITED STATES PATENT AND TRADEMARK OFFICE

CERTIFICATE OF CORRECTION

PATENT NO. : 5,369,328

DATED : November 29, 1994

INVENTOR(S) : Gruber, F., et al.

It is certified that error appears in the above-indentified patent and that said Letters Patent is hereby corrected as shown below:

Column 3; line 23: "sane" should read "same"
Column 4; line 28: delete L5
Column 4; line 40: "9" should read "9A"

Signed and Sealed this

Twenty-first Day of March, 1995

*Attest:*

Bruce Lehman

BRUCE LEHMAN

*Attesting Officer*

*Commissioner of Patents and Trademarks*